US011311167B2

(12) United States Patent
Rukavina et al.

(10) Patent No.: US 11,311,167 B2
(45) Date of Patent: Apr. 26, 2022

(54) EXTRACTOR TANK ASSEMBLY

(71) Applicant: TTI (Macao Commercial Offshore) Limited, Macau (MO)

(72) Inventors: Douglas M. Rukavina, Concord, NC (US); Donovan Bode, Charlotte, NC (US)

(73) Assignee: TECHTRONIC FLOOR CARE TECHNOLOGY LIMITED, Tortola (VG)

( * ) Notice: Subject to any disclaimer, the term of this patent is extended or adjusted under 35 U.S.C. 154(b) by 456 days.

(21) Appl. No.: 16/566,057

(22) Filed: Sep. 10, 2019

(65) Prior Publication Data

US 2020/0000303 A1 Jan. 2, 2020

Related U.S. Application Data

(63) Continuation of application No. 16/220,771, filed on Dec. 14, 2018.

(Continued)

(51) Int. Cl.

| | |
|---|---|
| ***A47L 11/40*** | (2006.01) |
| ***A47L 7/00*** | (2006.01) |
| ***A47L 11/34*** | (2006.01) |

(52) U.S. Cl.

CPC ..... *A47L 11/4016* (2013.01); *A47L 7/0004* (2013.01); *A47L 7/0023* (2013.01);

(Continued)

(58) Field of Classification Search

CPC .. A47L 11/4016; A47L 7/0004; A47L 7/0023; A47L 7/0038; A47L 11/34; A47L 11/4025

See application file for complete search history.

(56) References Cited

U.S. PATENT DOCUMENTS

| | | | |
|---|---|---|---|
| 5,784,755 | A | 7/1998 | Karr et al. |
| 5,839,159 | A | 11/1998 | Karr et al. |

(Continued)

FOREIGN PATENT DOCUMENTS

| | | | |
|---|---|---|---|
| CN | 1768692 | A | 5/2006 |
| CN | 1957825 | A | 5/2007 |

(Continued)

OTHER PUBLICATIONS

Notification for Granting the Patent Right for Invention and Search Report for related Chinese Application No. 201880089790.1 completed Aug. 7, 2021.

(Continued)

*Primary Examiner* — David Redding

(74) *Attorney, Agent, or Firm* — William S. Nabors; Moore & Van Allen PLLC; R. W. McCord Rayburn

(57) ABSTRACT

A recovery tank for a surface cleaning apparatus such as an extractor is provided. The apparatus comprises a base positionable on the surface to be cleaned and includes a suction nozzle having a suction inlet in fluid communication with a duct and an exhaust outlet. The recovery tank is mountable to the base and has one or more walls and a bottom surface. The recovery tank includes a tank inlet extending through the bottom surface, wherein the tank inlet is positioned adjacent the base and operatively coupled to the duct outlet when the recovery tank is mounted to the base. A tank air outlet extends through the bottom surface, wherein the tank air outlet is positioned adjacent the base and operatively coupled to the exhaust outlet when the recovery tank is mounted to the base. A tank air outlet tube extends into the recovery tank from the tank air outlet.

20 Claims, 9 Drawing Sheets

Related U.S. Application Data

(60) Provisional application No. 62/608,968, filed on Dec. 21, 2017.

(52) U.S. Cl.
CPC ..... *A47L 7/0038* (2013.01); *A47L 11/34* (2013.01); *A47L 11/4025* (2013.01)

(56) References Cited

U.S. PATENT DOCUMENTS

| | | | |
|---|---|---|---|
| 5,887,313 | A | 3/1999 | Hanold et al. |
| 5,933,912 | A | 8/1999 | Karr et al. |
| 6,073,300 | A | 6/2000 | Zahuranec et al. |
| 6,082,376 | A | 7/2000 | Karr et al. |
| 6,154,917 | A | 12/2000 | Zahuranec et al. |
| 6,467,122 | B2 | 10/2002 | Lenkiewicz et al. |
| 6,725,498 | B2 | 4/2004 | Symensma et al. |
| 6,832,409 | B2 | 12/2004 | Morgan et al. |
| 6,842,942 | B2 | 1/2005 | Morgan et al. |
| 7,178,196 | B2 | 2/2007 | Morgan et al. |
| 7,222,389 | B2 | 5/2007 | Morgan et al. |
| 7,331,082 | B2 | 2/2008 | Hertrick et al. |
| 7,657,964 | B2 | 2/2010 | Parr et al. |
| 7,725,983 | B2 | 6/2010 | O'Neal |
| 7,814,612 | B2 | 10/2010 | Sepke et al. |
| 7,850,383 | B2 | 12/2010 | Bober et al. |
| 8,291,546 | B2 | 10/2012 | Louis et al. |
| 8,366,336 | B2 | 2/2013 | Bober et al. |
| 8,375,506 | B2 | 2/2013 | Chaney |
| 8,608,396 | B2 | 12/2013 | Bober et al. |
| 8,707,510 | B2 | 4/2014 | Reed, Jr. |
| 9,320,402 | B2 | 4/2016 | Krondorfer et al. |
| 9,427,128 | B2 | 8/2016 | DeJonge et al. |
| 9,434,400 | B2 | 9/2016 | Olson et al. |
| 2005/0257340 | A1 | 11/2005 | Parrott |
| 2008/0279610 | A1 | 11/2008 | Bober et al. |
| 2009/0229069 | A1 | 9/2009 | Lenkiewicz et al. |
| 2015/0216385 | A1 | 8/2015 | Bantum |

FOREIGN PATENT DOCUMENTS

| | | | |
|---|---|---|---|
| CN | 101150975 | A | 3/2008 |
| CN | 101356319 | A | 1/2009 |
| CN | 101686786 | B | 3/2010 |
| CN | 102018474 | B | 4/2011 |
| CN | 203369863 | U | 1/2014 |
| CN | 104172996 | A | 12/2014 |
| CN | 204520546 | U | 8/2015 |
| CN | 204765438 | U | 11/2015 |
| CN | 205126127 | | 4/2016 |
| CN | 105979842 | A | 9/2016 |
| CN | 106137053 | A | 11/2016 |
| CN | 206365853 | U | 8/2017 |
| DE | 202012011402 | U1 | 1/2013 |
| EP | 2494902 | A2 | 5/2012 |
| EP | 2805659 | A2 | 11/2014 |

OTHER PUBLICATIONS

Office Action for Chinese Application No. 201880089790.1 dated Mar. 26, 2021, 8 pages.

International Search Report and Written Opinion for International Patent Application No. PCT/US2018/065775 completed Mar. 22, 2019.

EXTRACTOR TANK ASSEMBLY

CROSS-REFERENCE TO RELATED APPLICATIONS

This application is a continuation of U.S. patent application Ser. No. 16/220,771, filed on Dec. 14, 2018, which is a non-provisional filing of U.S. Provisional Application No. 62/608,968, filed Dec. 21, 2017, the contents of which are hereby incorporated by reference herein.

BACKGROUND

Surface cleaning devices, such as dry vacuums and wet extractors, are used to remove dirt, stains, and other various debris from a surface, such as a carpet or hard floor. Wet extractors typically apply a cleaning fluid or solution to the surface before agitating the surface with a brush and then recovering the applied cleaning solution with suction to remove dirt or debris from the surface along with the recovered fluid into a liquid recovery tank. There exists a need for a recovery tank support structure for an extractor that provides tank support while allowing for device maneuverability and convenience of operation by the user.

BRIEF SUMMARY

An apparatus for cleaning a surface is disclosed. The apparatus comprises a base positionable on the surface to be cleaned, the base including: a suction nozzle having a suction inlet; a duct in fluid communication with the suction inlet and having a duct outlet; and an exhaust outlet. The apparatus also includes an upper portion operatively coupled to the base pivotable between an upright storage position and an operating position. The apparatus further comprises a recovery tank removably mounted to the base, the recovery tank having one or more walls and a bottom surface. The recovery tank includes a tank inlet extending through the bottom surface, wherein the tank inlet is positioned adjacent the base and operatively coupled to the duct outlet when the recovery tank is mounted to the base; a tank air outlet extending through the bottom surface, wherein the tank air outlet is positioned adjacent the base and operatively coupled to the exhaust outlet when the recovery tank is mounted to the base; and a tank air outlet tube extending into the recovery tank from the tank air outlet.

An apparatus for cleaning a surface is also disclosed. The apparatus comprises a base positionable on the surface to be cleaned, the base including: a suction nozzle having a suction inlet; a duct in fluid communication with the suction inlet and having a duct outlet; and an exhaust outlet rearward of the duct outlet. The apparatus also includes an upper portion operatively coupled to the base pivotable between an upright storage position and an operating position. The apparatus further comprises a recovery tank removably mounted to the base, the recovery tank having one or more walls and a bottom surface. The recovery tank includes a tank inlet extending through the bottom surface, wherein the tank inlet is positioned adjacent the base and operatively coupled to the duct outlet when the recovery tank is mounted to the base; a tank air outlet extending through the bottom surface, wherein the tank air outlet is positioned adjacent the base and operatively coupled to the exhaust outlet when the recovery tank is mounted to the base; and a tank air outlet tube extending into the recovery tank from the tank air outlet.

The features, functions, and advantages that have been discussed may be achieved independently in various embodiments of the device and methods described herein or may be combined with yet other embodiments, further details of which can be seen with reference to the following description and drawings.

BRIEF DESCRIPTION OF DRAWINGS

The foregoing and other advantages and features of the disclosure, and the manner in which the same are accomplished, will become more readily apparent upon consideration of the following detailed description of the disclosure taken in conjunction with the accompanying drawings, which illustrate embodiments of the disclosure and which are not necessarily drawn to scale, wherein.

DETAILED DESCRIPTION

Figure 1:
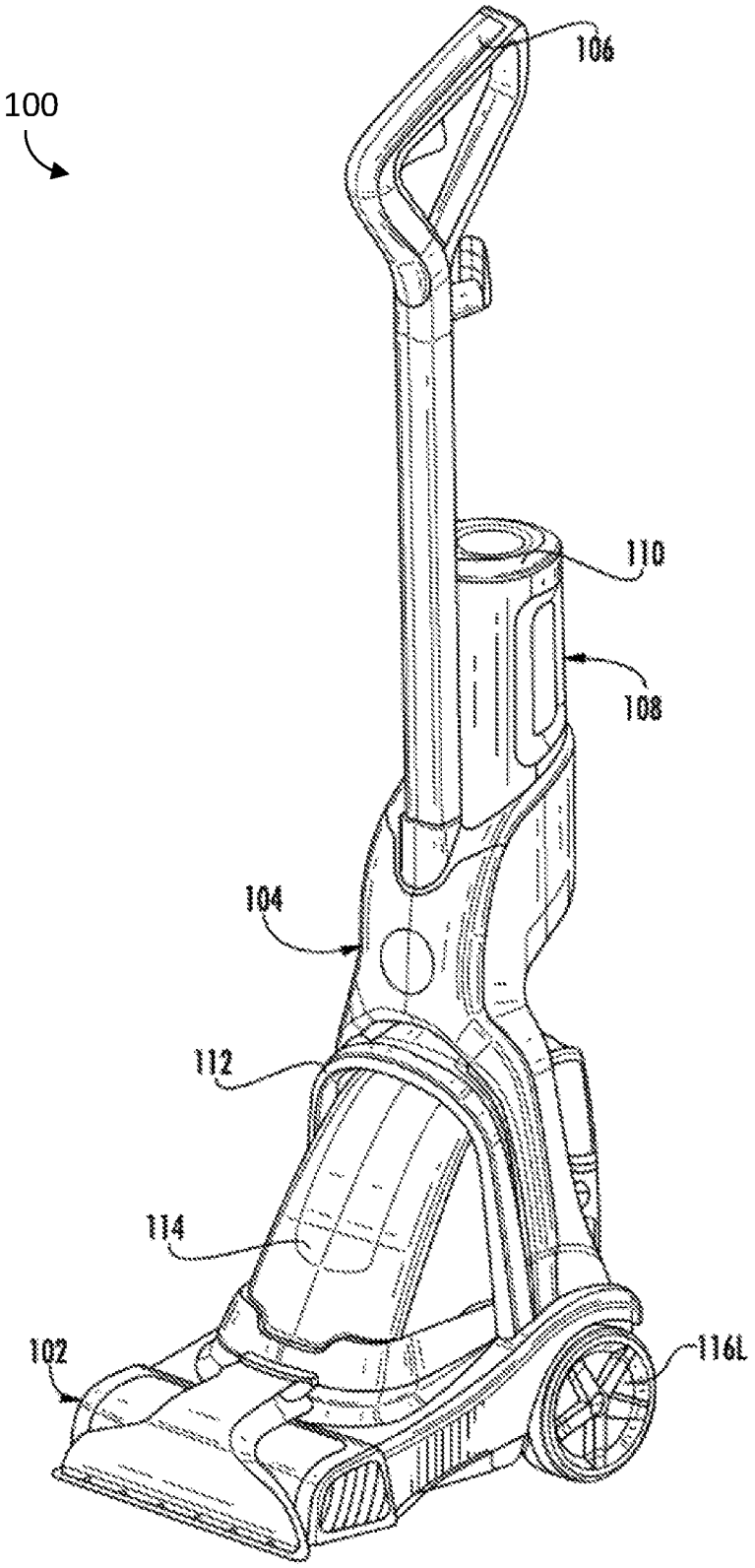
FIG. 1 illustrates a perspective view of a surface cleaning device, in accordance with one embodiment.

Embodiments of the present invention now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together. Furthermore, operatively coupled components may mean that the components retain at least some freedom of movement in one or more directions or may be rotated about an axis (i.e., rotationally coupled). Furthermore, "operatively coupled" may mean that components may be electronically connected and/or in fluid communication with one another.

It should be understood that a "switch," as used herein, refers to any device used for completing or breaking an electrical or mechanical or fluid connection. A user-interface for a switch may be embodied as a button, lever, dial, touch-screen interface, electronic switch, or the like. The switch may be actuated manually by a user of the surface cleaning device or automatically by a controller, computer, or other electronic interface to enact a change in device operation.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

FIGS. 1-4 illustrate a collection of views of a surface cleaning device, in accordance with one embodiment of the invention. The surface cleaning device, as depicted in the embodiment of FIGS. 1-4, is an upright carpet extractor. The upright carpet extractor of the present invention provides a support structure for a tank, such as a fluid recovery tank, allowing for enhanced maneuverability of the upright carpet extractor while inhibiting movement of the tank relative to the base during operation of the extractor. The support structure encircles a portion of the tank to provide support during movement of the extractor.

Figure 2:
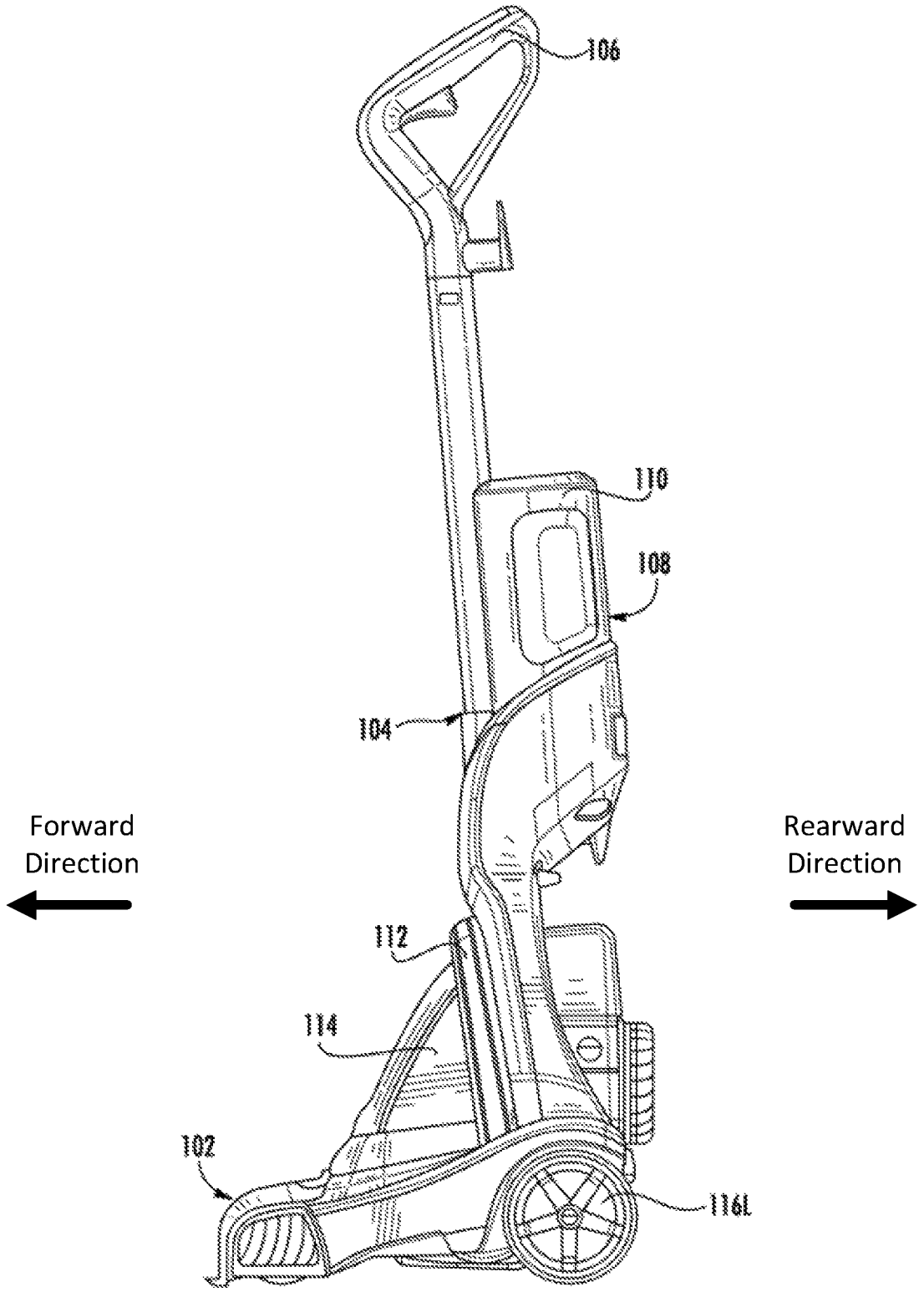
FIG. 2 illustrates a side view of the surface cleaning device, in accordance with one embodiment.
Figure 3:
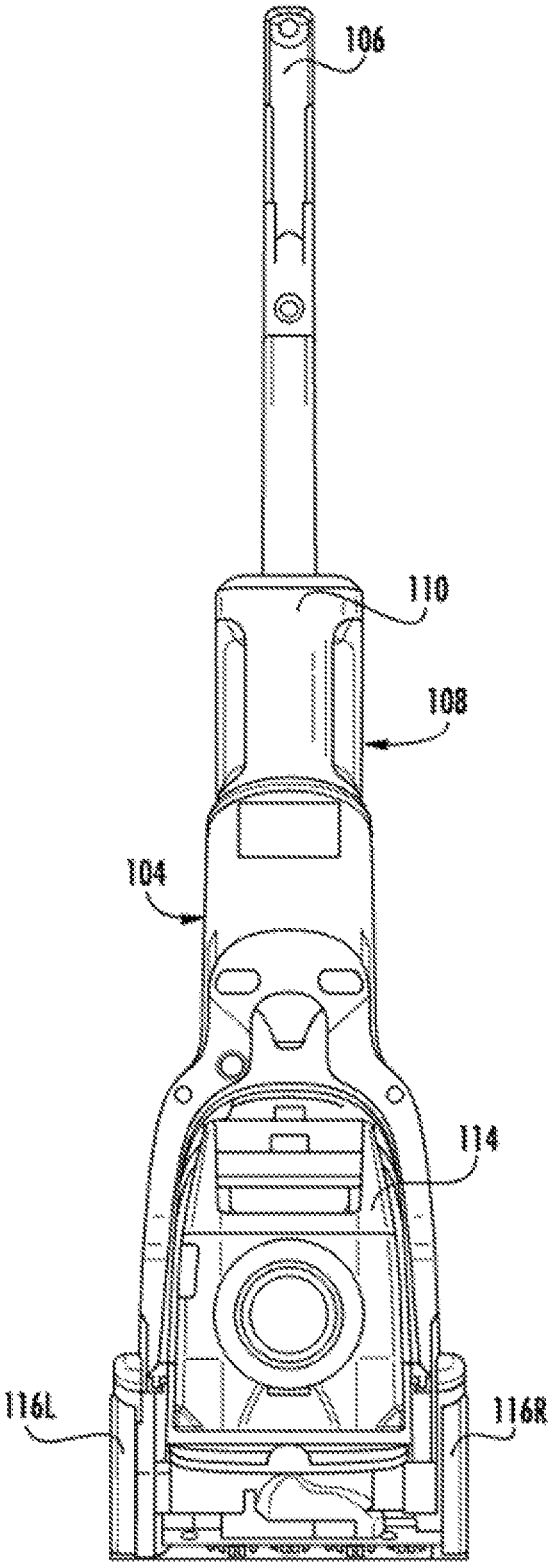
FIG. 3 illustrates a rear view of the surface cleaning device, in accordance with one embodiment.
Figure 5:
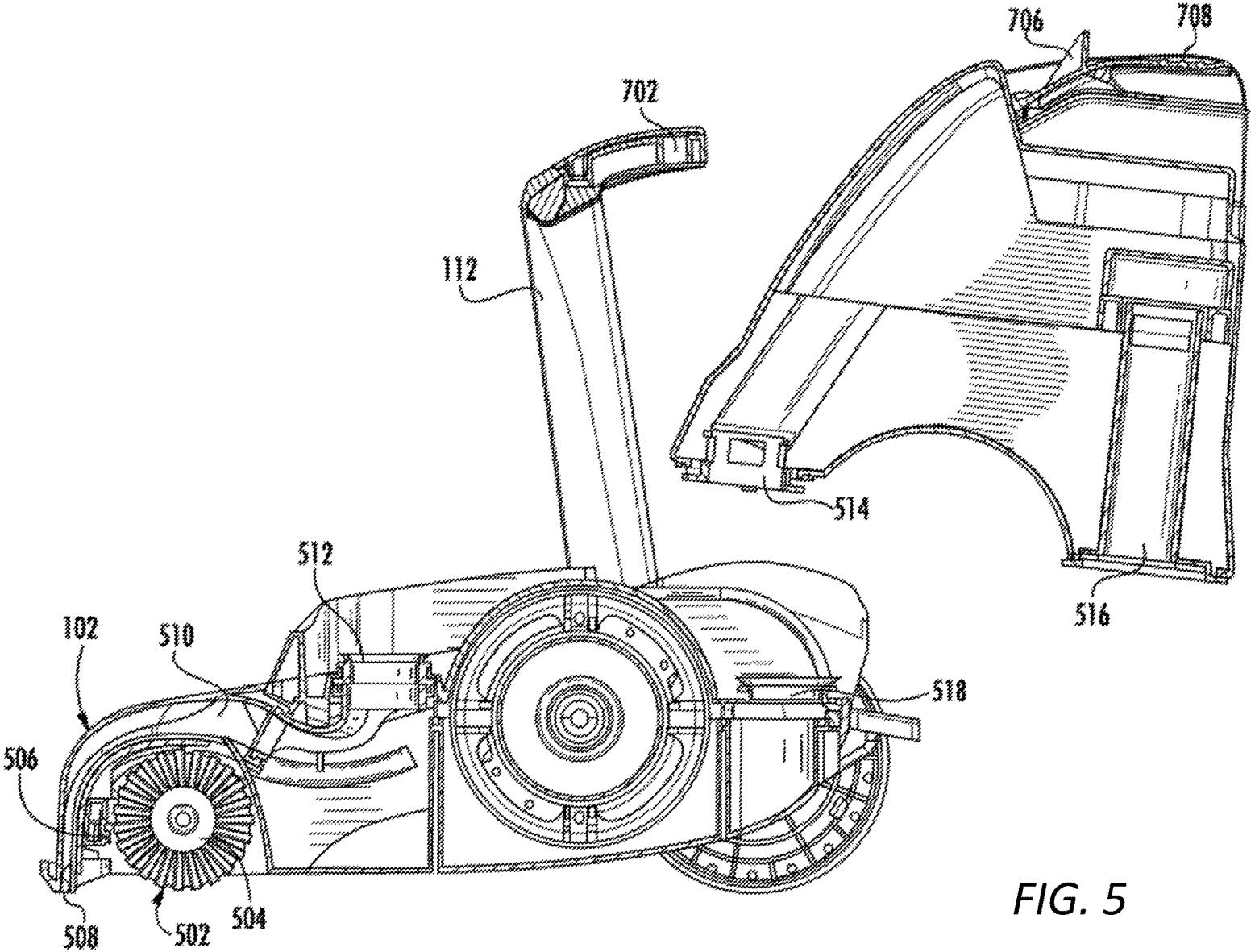
FIG. 5 illustrates a cross-sectional view of a base of the surface cleaning device and a removed recovery tank, in accordance with one embodiment.

In the embodiment shown in FIG. 1, the extractor 100 has a base 102 and an upper portion 104, wherein the upper portion 104 is operatively coupled to a rear portion of the base 102. In the illustrated embodiment, the base 102 further includes a brush assembly (as depicted in FIG. 5) for scrubbing and agitating the surface to be cleaned. The upper portion 104 is pivotally coupled to the base 102 allowing for pivoting movement of the upper portion 104 about the base 102 in forwards and rearwards directions as depicted in FIG. 2. The upper portion 104 has a handle portion 106 for positioning the base 102 on the surface with a pair of wheels 116R and 116L during operation of the extractor as depicted in FIG. 3. The extractor 100 includes a recovery tank 114 operatively coupled to the base 102, which is removably mounted to the base 102. The base 102 of the extractor 100 includes a support structure 112 operatively coupled to the base 102 for at least partially supporting the recovery tank 114. The support structure 112 will be described in further detail with respect to FIGS. 5-8.

Figure 4:
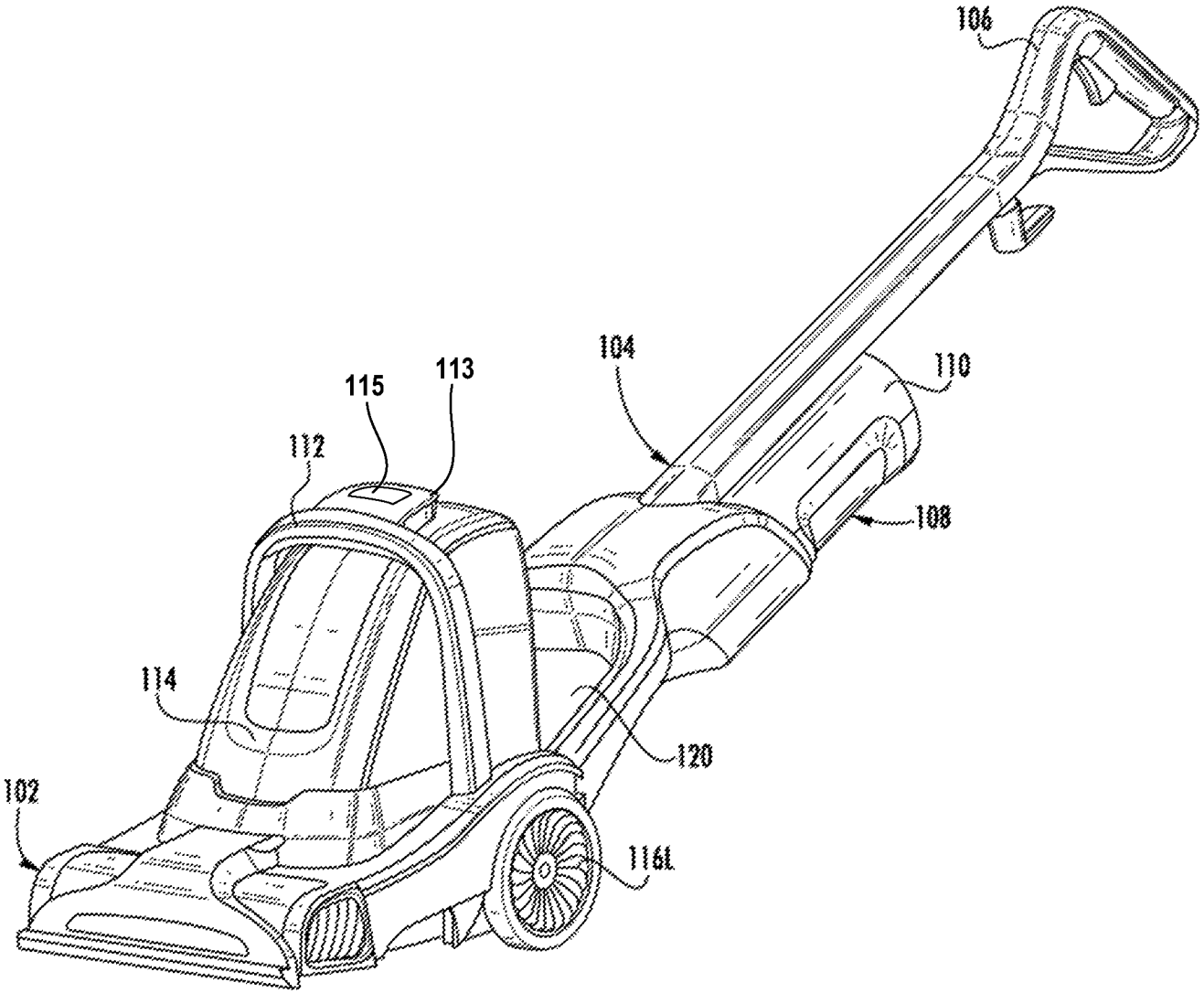
FIG. 4 illustrates a perspective view of the surface cleaning device in an operating position, in accordance with one embodiment.

The illustrated upper portion of the extractor 100 is pivotable between an upright storage position and an operating position. In the upright storage position (as depicted in FIGS. 1-3), the upper portion is maintained in an upwardly-extending orientation above the base, wherein the upper portion 104 is pivoted and positioned to extend substantially vertically above the base 102. As illustrated in FIG. 4, the upper portion 104 may include a yoke 120 that partially encircles the support structure and/or the recovery tank 114 when the recovery tank is positioned on the base 102 when the upper portion 104 is in the upright storage position. In one embodiment, the upper portion 104 is maintained in the upright storage position by a latch, lock, snap-fit, detent, spring, or other retention mechanism. As depicted in FIG. 4, the upper portion 104 may be movable to the operating position wherein the upper portion 104 is generally pivoted back in the rearward direction to provide enhanced leverage for the user to propel the extractor 100 along the surface.

As further depicted in FIGS. 1-4, a supply tank assembly 108 is operatively coupled to the extractor 100. In the illustrated embodiment, the supply tank assembly 108 includes one cleaning solution supply tank 110 that the user may fill with mixed cleaning solution for washing or clean water for rinsing as desired. In an alternative embodiment, the supply tank assembly 108 includes separate supply tanks for clean water and detergent, wherein the clean water and detergent are mixed to produce the cleaning solution. In other alternative embodiments, at least a portion of the supply tank assembly 108 may be mounted to the base 102, the support structure 112, and/or the recovery tank 114.

As illustrated in FIG. 5 and as previously discussed, the base 102 optionally includes a brush assembly 502 having one or more brushes 504 operatively coupled to the base 102. The one or more brushes 504 engage with the surface to agitate dirt and debris on the surface and scrub the surface assisting in the removal of the dirt and debris that is extracted along with recovered cleaning solution.

Cleaning solution or clean water flows through tubing from the supply tank 110, the flow being controlled by one or more valves. Tubing from the supply tank 110 delivers cleaning solution to a valve assembly (not shown), wherein the cleaning solution is selectively routed by the valve assembly to a distributer 506 during operation of the extractor. The cleaning solution is delivered through the tubing in the extractor 100 using gravity, or may be routed with the assistance of a pump. In the illustrated embodiment, cleaning solution is supplied to the distributer 506 in the base 102 using gravity. In one alternative, the distributor is ancillary to the base provided in an accessory tool in fluid communication with the supply tank, wherein the cleaning solution is supplied to the distributor in the cleaning tool using a pump (not shown).

The distributer 506 distributes the cleaning solution to the surface to be cleaned. In other embodiments, the distributor 506 may, optionally, at least partially distribute the cleaning solution to the one or more brushes 504 of the brush assembly 502. The one or more brushes 504 agitate and scrub the cleaning solution on the surface to dislodge any embedded dirt or debris. During operation, the extractor 100 distributes cleaning solution to the surface while substantially simultaneously extracting and recovering the applied cleaning solution in a continuous operation.

The applied cleaning solution is extracted from the surface by a suction nozzle 508. In the illustrated embodiment, the nozzle 508 has an inlet at least partially spanning the front portion of the base 102. The suction nozzle 508 is in fluid flow communication with the recovery tank 114 by way of an air duct 510 in the base 102. The air duct 510 includes a duct outlet 512 which, upon mounting the recovery tank 114 to the base 102, is operatively coupled to a tank inlet 514 of the recovery tank 114. A suction/vacuum source such as a motor fan assembly (not shown), housed in the base 102, draws air through the nozzle 508 and the air duct 510, through the recovery tank 114 to then exhaust the air to the external atmosphere. In other embodiments, the suction source may be housed in a different portion of the extractor 100, such as the upper portion 104. In one alternative, the suction nozzle is ancillary to the base provided in an accessory tool in fluid communication with the recovery tank.

The recovery tank 114 includes an air and liquid separator (not shown), such as one or more baffles or other separator as is understood by one skilled in the art, for separating the liquid (i.e., the recovered cleaning solution) from the air entering the recovery tank 114 and recovering the separated liquid for storage in the recovery tank 114. The recovery tank 114 includes an air outlet 516 that operatively couples with an exhaust outlet 518 of the base 102 when the recovery tank 114 is removably mounted to the base 102. In the illustrated embodiment, the recovery tank 114 is removably coupled to the base 102 to allow the user to remove the recovery tank 114 from the base and empty the liquid contents.

Figure 6A:
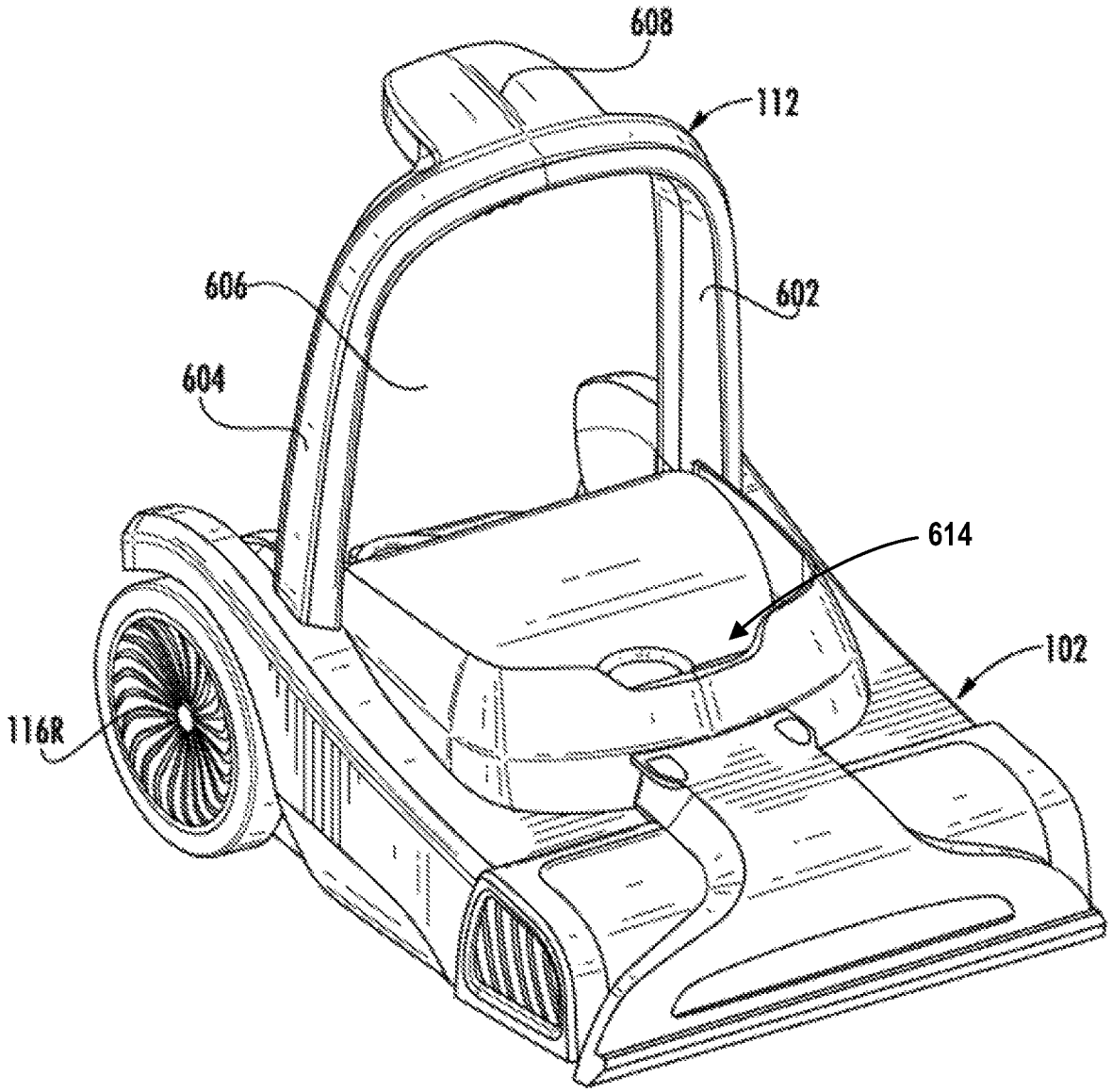
FIG. 6A illustrates a perspective view of the front of the base of the surface cleaning device, in accordance with one embodiment.
Figure 6B:
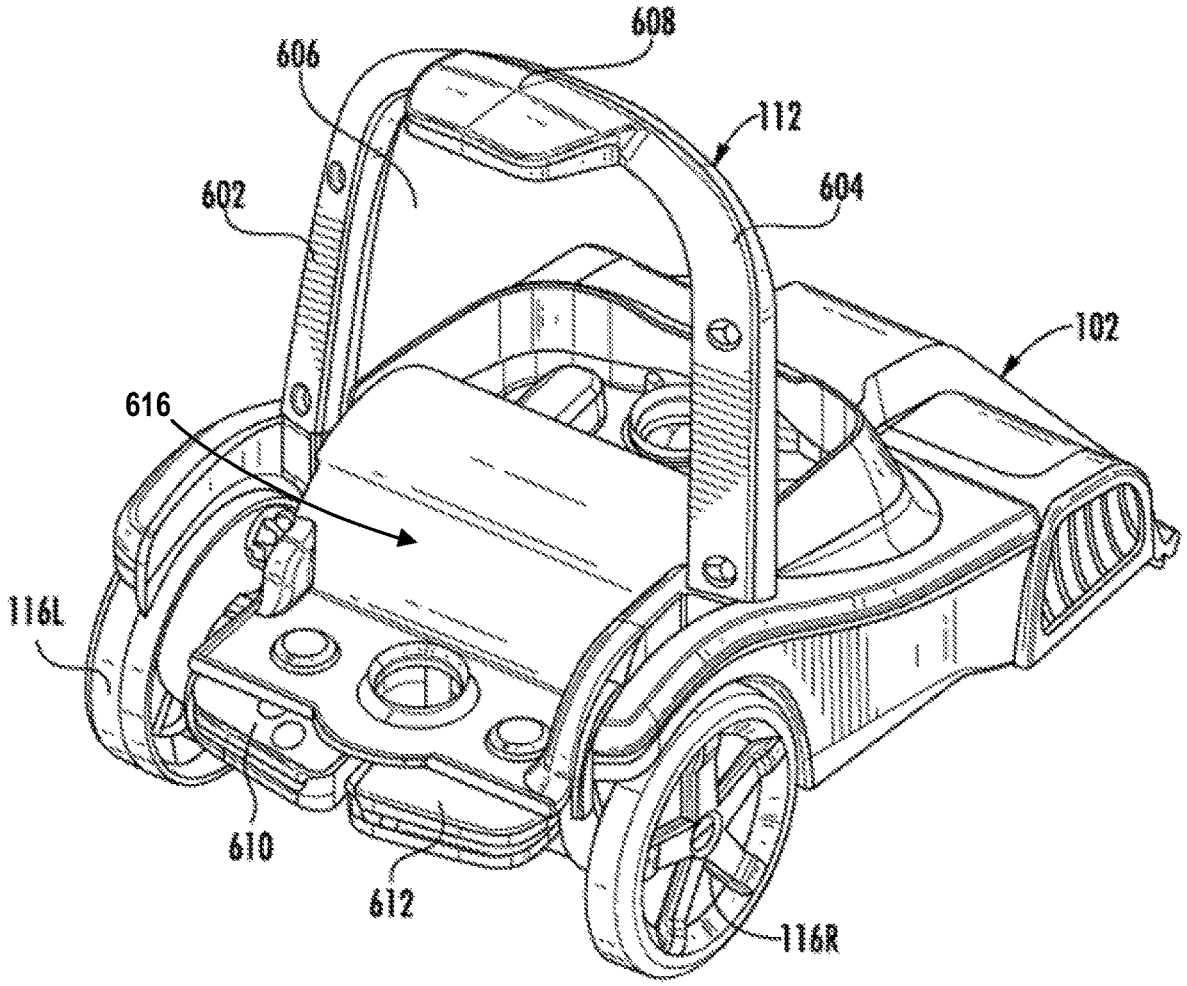
FIG. 6B illustrates a perspective view of the rear of the base of the surface cleaning device, in accordance with one embodiment.
Figure 6C:
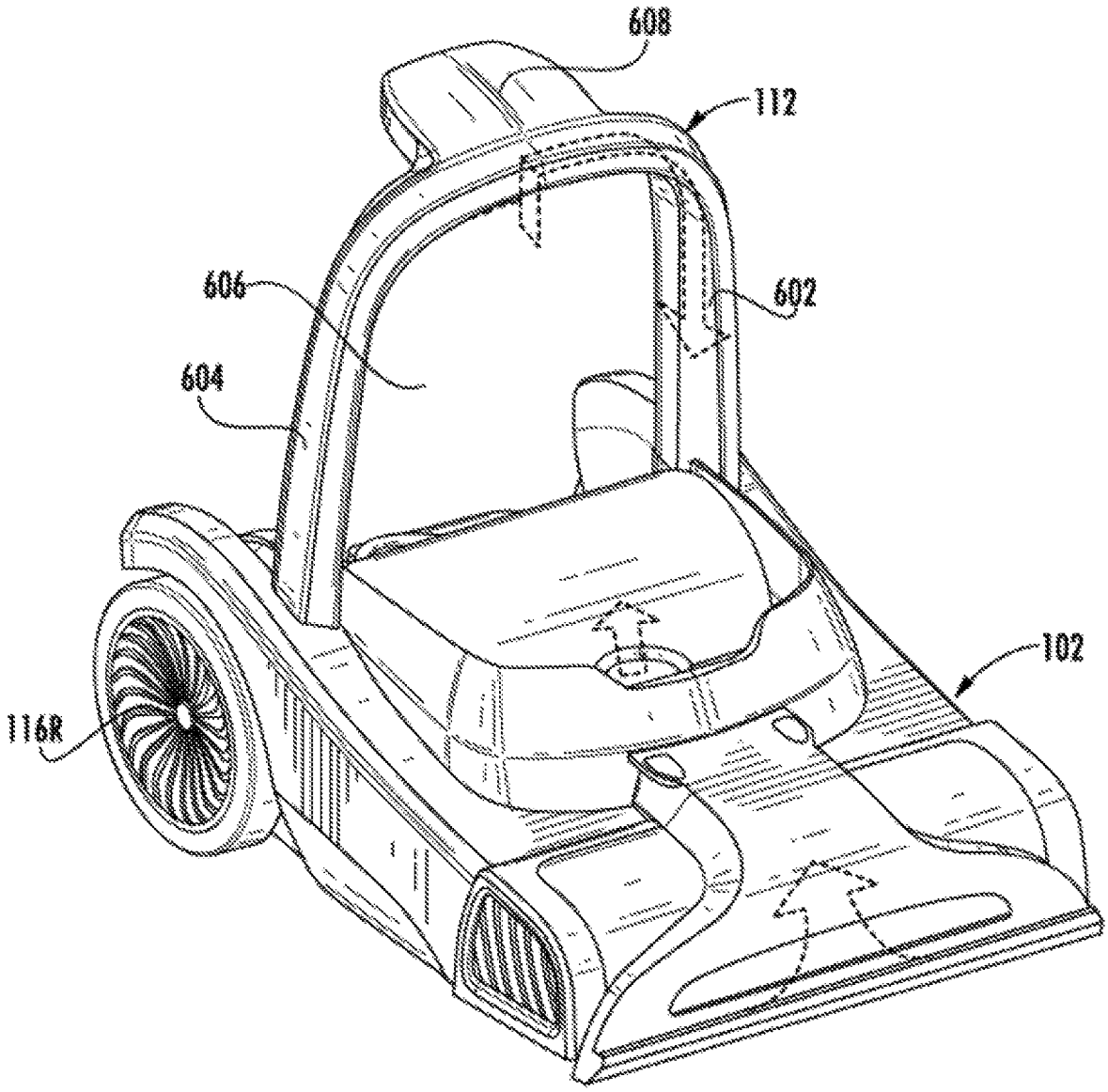
FIG. 6C illustrates a perspective view of the front of the base of the surface cleaning device having an airflow path.

Referring now to FIGS. 6A and 6B, as previously discussed, the base 102 of the extractor 100 includes a support structure 112 operatively coupled to the base 102 at least partially supporting the recovery tank 114. In the illustrated embodiment, the arch of the support structure 112 forms a substantially ring-shaped structure, however the support structure 112 may be formed in any shape as to allow it to accommodate the recovery tank 114. The support structure 112 extends from the base 102 in a substantially upward direction forming an arch creating a void 606 beneath the support structure and above a surface of the base. The support structure at least partially encircles the recovery tank 114 when the recovery tank 114 is positioned in the void 606 created by the support structure 112 and the surface of the base 102. In the illustrated embodiment, the support structure 112 and the surface of the base 102 form a hoop that defines the void 606.

In the illustrated embodiment, the upper portion 104 is pivotally coupled to the base 102 providing pivoting movement of the upper portion 104 independent of the support structure 112. Stated another way, the support structure 112 remains in a position relative to the base 102 while the upper portion 104 pivots in a forward or rearward direction. The support structure 112 remains engaged with the recovery tank 114 as the upper portion 104 is pivoted by a user propelling the extractor 100, thereby inhibiting lateral movement, swaying, or accidental displacement of the recovery tank 114 during operation. The incorporation of the dedicated support structure 112 allows for a wide range of upper portion 104 movement and extractor 100 maneuverability while still providing support for the recovery tank 114 to prevent spills of liquid stored within.

Figure 7:
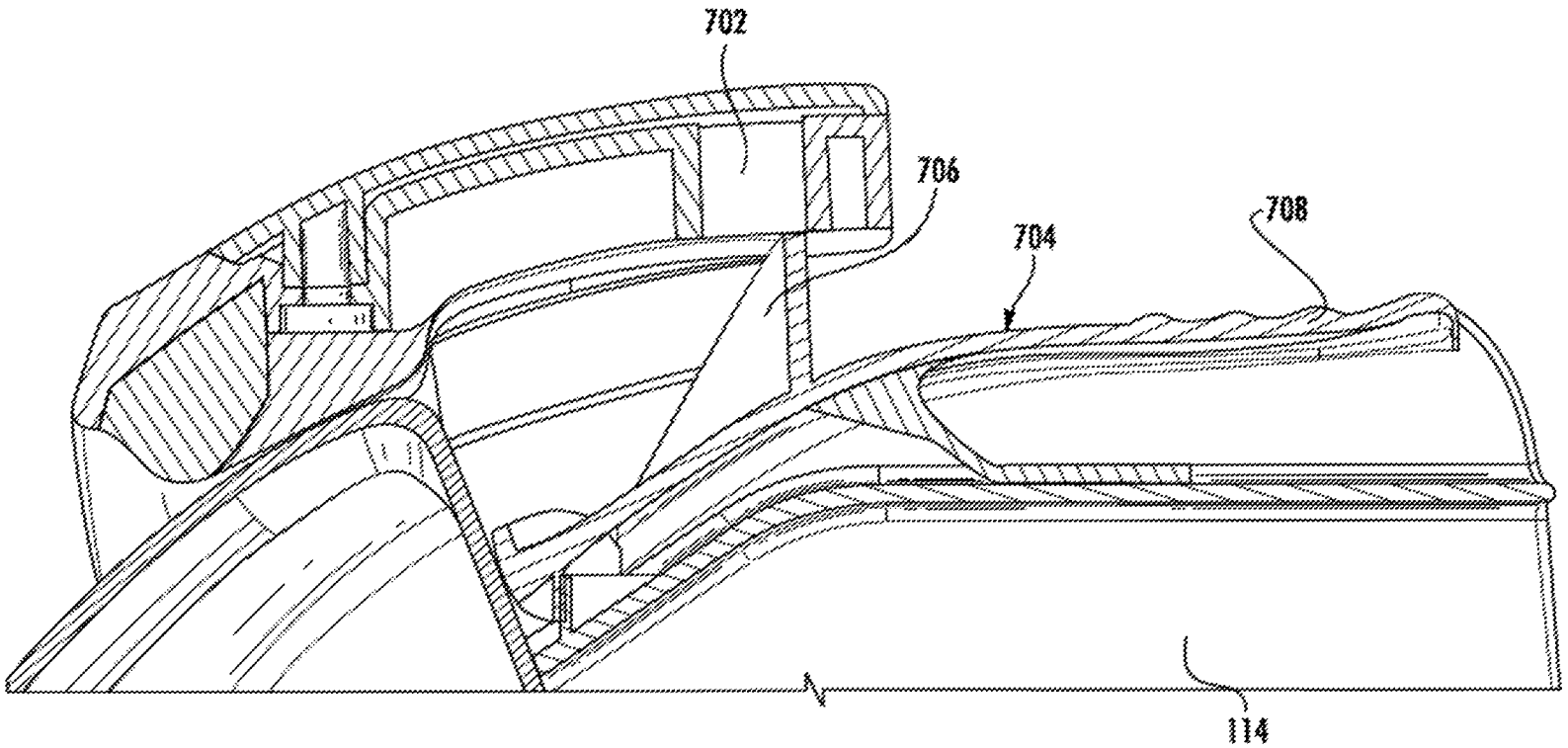
FIG. 7 illustrates a cross-sectional view of a recovery tank locking mechanism, in accordance with one embodiment.

In the illustrated embodiment, the recovery tank 114 is removably mounted to the base 102, wherein the support structure 112 engages the recovery tank 114. As shown in FIG. 7, the support structure 112 engages the recovery tank 114 by a locking mechanism 700 such as a latch 704. The support structure 112 may engage the recovery tank 114 at one or more discrete portions of the recovery tank, such as by the latch 704. Alternatively or additionally, the support structure 112 may engage the recovery tank 114 along one or more continuous portions of a perimeter of the recovery tank. In an alternative embodiment, the support structure 112 provides support to the recovery tank 114 without requiring constant engagement with the recovery tank 114, wherein the support structure 112 is spaced apart from the recovery tank 114 and only directly engages the recovery tank 114 when the recovery tank 114 shifts out of position, and wherein the support provided by the support structure 112 during direct engagement with the recovery tank 114 prevents excessive displacement of the recovery tank 114 that would otherwise hinder operation of the extractor 100.

In the illustrated embodiment, the recovery tank 114 is removed from the support structure 112 from the rear of the extractor 110. The base 102 has a forward portion 614 and a rearward portion 616, and the recovery tank 114 is removable from the rearward portion 616. The recovery tank may also be removable in a direction toward the rearward portion. In alternative embodiments, the recovery tank 114 may be optionally removable from either the forward portion 614, the rearward portion 616, or another portion of the base 102.

In the illustrated embodiment, the support structure 112 is rigidly coupled to the base 102, wherein the support structure 112 is fixed in a position relative to the base 102. Alternatively, in another embodiments, the support structure 112 is pivotable about the base 102 in forward and rearward directions in order to facilitate user access to the recovery tank 114 when the recovery tank 114 is removably mounted to the base 102. In one alternative a user wishing to remove the mounted recovery tank 114 pivots the support structure 112 in a forward direction to disengage at least a portion of the recovery tank 114 from the support structure and facilitate removal of the recovery tank 114, for example, removal in a forward or rearward direction from the extractor 100. A selectively pivotable support structure 112 provides clearance for the recovery tank 114 to be unobstructed by the support structure 112 during removal from the base 102.

In one embodiment, the support structure 112 includes a first arm 602 and a second arm 604 forming the support structure 112. In one embodiment, the first arm 602 and second arm 604 are operatively coupled to one another at the upper section 608 of the support structure 112. Alternatively or additionally, the first arm 602 and the second arm 604 are independently pivotably mounted to, and optionally removable from, the base 102 allowing for modular arrangement of the support structure 112 when accessing various components of the extractor 100.

In one embodiment, the yoke 120 of the upper portion 104 abuts the support structure 112 while the extractor 100 is positioned in the upright storage position. By abutting the upper portion 104, the support structure 112 aids in supporting the upper portion and limits a range of forward pivoting movement of the upper portion 104 while the extractor 100 is in the upright storage position. In another embodiment, the upper portion 104 is operatively coupled to the support structure 112 while in the upright storage position, wherein the upper portion 104 is snapped or locked onto a portion of the support structure 112 in the upright storage position. In the illustrated embodiment, the yoke does not contact the support structure 112 and is operatively coupled to the base 102 while in the upright storage position, wherein the upper portion 104 is snapped or locked onto a portion of the base 102 in the upright storage position.

In one embodiment, the support structure 112 includes a handle 113 located on or formed as a part of the support structure 112 for lifting the base 102. For example, a user may engage the support structure handle 113 to assist in lifting the entire extractor 100 off of a surface for transport. In another embodiment, the support structure 112 is removably coupled to the base 102, wherein the support structure 112 is removable from the base 102 with the recovery tank 114. In these embodiments, the support structure handle 113 is engaged by the user to assist in lifting the recovery tank 114 and/or the removably coupled support structure 112 from the base 102, for example, when the user wishes to empty the recovery tank 114.

FIG. 7 illustrates a cross-sectional view of one embodiment of a recovery tank locking mechanism. The locking mechanism 700 provides locking engagement between the support structure 112 and the recovery tank 114. A recess 702 is positioned on an interior portion of the support structure 112, wherein the recess 702 is configured for receiving a latch 704 operatively coupled to the recovery tank 114. The latch 704 includes a protrusion 706 operatively coupled to a recoverably deformable actuator 708.

The protrusion 706 is at least partially positioned within the recess 702 of the support structure 112 while the recovery tank 114 is removably mounted one the base 102 to retain the recovery tank 114. The protrusion 706 is released from the recess 702 when the actuator 708 is depressed by the user allowing the recovery tank 114 to be removed from the support structure 112 and the base 102. The protrusion 705 has an angled surface that automatically actuates the latch 704 during replacement of the recovery tank 114.

In another embodiment, the support structure 112 includes a user interface component 115 (e.g., switch, indicator, interactive display, visual display, lights or icons, decorative lights, or the like) positioned on a portion of the support structure 112 such as the upper section 608 of the support structure 112 or on a top surface of the support structure handle 113. In this way, the user interface component 115 is easily viewable and accessible by the user while the extractor 100 is in either a storage position or an operating position. In one alternative, the support structure includes a light providing illumination of the working surface.

In one embodiment, the support structure includes one or more airflow passageways. As illustrated schematically in FIG. 6C, the extractor may be configured to draw air out of the recovery tank through a passageway in the support structure. Alternatively or additionally, the extractor may be configured to draw air into the recovery tank through a passageway in the support structure. In other embodiments, fluid delivery may be provided through fluid conduits routed through the support structure.

In an embodiment, an apparatus for cleaning a surface is provided, the apparatus comprising: a base positionable on the surface; the base including a support structure operatively coupled to and extending from the base, the support structure forming an arch creating a void beneath the support structure and above a surface of the base; and a tank removably mounted to the base and located in the void between the support structure and the base, wherein the support structure engages the tank. In one aspect, the support structure at least partially encircles the tank when the tank is positioned within the void.

In another aspect, alone or in combination with any one of the previous aspects or any combination thereof, the support structure and the surface of the base forms a hoop around the void. In another aspect, alone or in combination with any one of the previous aspects or any combination thereof, the support structure is configured to inhibit movement of the tank relative to the base during operation of the apparatus. In another aspect, alone or in combination with any one of the previous aspects or any combination thereof, the support structure further comprises a handle for lifting at least one of the tank and the apparatus.

In another aspect, alone or in combination with any one of the previous aspects or any combination thereof, the apparatus further comprises an upper portion operatively coupled to the base, wherein the upper portion includes a handle. In another aspect, alone or in combination with any one of the previous aspects or any combination thereof, the upper portion is pivotally connected to the base independent of the support structure. In another aspect, alone or in combination with any one of the previous aspects or any combination thereof, the apparatus further comprises a locking mechanism releasably coupling the tank to the support structure. In another aspect, alone or in combination with any one of the previous aspects or any combination thereof, the upper portion is pivotable between an upright storage position and an operating position, wherein the upper portion is maintained in an upward-extending orientation above the base in the upright storage position. In another aspect, alone or in combination with any one of the previous aspects or any combination thereof, the upper portion further comprises a yoke that partially encircles at least one of the support structure and the tank positioned on the base when the upper portion is in the upright storage position. In another aspect, alone or in combination with any one of the previous aspects or any combination thereof, the support structure is pivotable relative to the base facilitating access to the tank.

In another aspect, alone or in combination with any one of the previous aspects or any combination thereof, the base has a forward portion and a rearward portion, and wherein the tank is removable from the rearward portion. In another aspect, alone or in combination with any one of the previous aspects or any combination thereof, the apparatus further comprises a nozzle, wherein the tank is a liquid recovery tank in fluid communication with the nozzle.

In another aspect, alone or in combination with any one of the previous aspects or any combination thereof, the support structure is releasable from the base facilitating access to the tank. In another aspect, alone or in combination with any one of the previous aspects or any combination thereof, the support structure is removable from the base. In another aspect, alone or in combination with any one of the previous aspects or any combination thereof, the support structure further comprises at least one feature selected from a group consisting of a display, an indicator, a light, and a switch. In another aspect, alone or in combination with any one of the previous aspects or any combination thereof, the support structure further comprises an airflow passageway or a fluid conduit.

In another aspect, alone or in combination with any one of the previous aspects or any combination thereof, the support structure further comprises a first arm and a second arm forming at least a portion of the support structure, the first arm and the second arm being pivotably mounted to the base. In another aspect, alone or in combination with any one of the previous aspects or any combination thereof, the first arm and the second arm are operatively coupled at an upper portion of the support structure. In another aspect, alone or in combination with any one of the previous aspects or any combination thereof, at least one of the first arm and the second arm being independently moveable or removable relative to the base.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. An apparatus for cleaning a surface, the apparatus comprising:

a base positionable on the surface to be cleaned, the base including:

a suction nozzle having a suction inlet; and a duct in fluid communication with the suction inlet and having a duct outlet; and an exhaust outlet;

an upper portion operatively coupled to the base pivotable between an upright storage position and an operating position; and a recovery tank removably mounted to the base, the recovery tank having one or more walls and a bottom surface, the recovery tank including:

a tank inlet extending through the bottom surface, wherein the tank inlet is positioned adjacent the base and operatively coupled to the duct outlet when the recovery tank is mounted to the base;

a tank air outlet extending through the bottom surface, wherein the tank air outlet is positioned adjacent the base and operatively coupled to the exhaust outlet when the recovery tank is mounted to the base; and a tank air outlet tube extending into the recovery tank from the tank air outlet.

2. The apparatus of claim 1, wherein at least a portion of the tank air outlet tube is spaced from the one or more walls to create a gap between the tank air outlet tube and the one or more walls.

3. The apparatus of claim 2, wherein the portion of the tank air outlet tube is spaced from the one or more walls to allow fluid to flow around the portion of the tank air outlet tube spaced from the one or more walls.

4. The apparatus of claim 2, wherein the one or more walls comprise a rear wall, wherein the tank air outlet tube is spaced from the rear wall.

5. The apparatus of claim 1, the recovery tank further including a tank inlet tube extending into the recovery tank from the tank inlet.

6. The apparatus of claim 5, wherein at least a portion of the tank inlet tube is spaced from the one or more walls to create a gap between the tank inlet tube and the one or more walls.

7. The apparatus of claim 6, wherein the portion of the tank inlet tube is spaced from the one or more walls to allow fluid to flow around the portion of the tank inlet tube spaced from the one or more walls.

8. The apparatus of claim 6, wherein the one or more walls comprise a front wall, wherein the tank inlet tube is spaced from the front wall.

9. The apparatus of claim 5, wherein the tank inlet tube extends into the recovery tank in a rearward direction.

10. The apparatus of claim 1, wherein the base includes a front portion and a rearward portion, and wherein the upper portion is operatively coupled to the rearward portion of the base.

11. An apparatus for cleaning a surface, the apparatus comprising:

a base positionable on the surface to be cleaned, the base including:

a suction nozzle having a suction inlet; and a duct in fluid communication with the suction inlet and having a duct outlet; and an exhaust outlet rearward of the duct outlet;

an upper portion operatively coupled to the base pivotable between an upright storage position and an operating position; and a recovery tank removably mounted to the base, the recovery tank having one or more walls and a bottom surface, the recovery tank including:

a tank inlet extending through the bottom surface, wherein the tank inlet is positioned adjacent the base and operatively coupled to the duct outlet when the recovery tank is mounted to the base;

a tank air outlet extending through the bottom surface, wherein the tank air outlet is positioned adjacent the base and operatively coupled to the exhaust outlet when the recovery tank is mounted to the base; and a tank air outlet tube extending into the recovery tank from the tank air outlet.

12. The apparatus of claim 11, wherein at least a portion of the tank air outlet tube is spaced from the one or more walls to create a gap between the tank air outlet tube and the one or more walls.

13. The apparatus of claim 12, wherein the portion of the tank air outlet tube is spaced from the one or more walls to allow fluid to flow around the portion of the tank air outlet tube spaced from the one or more walls.

14. The apparatus of claim 12, wherein the one or more walls comprise a rear wall, wherein the tank air outlet tube is spaced from the rear wall.

15. The apparatus of claim 11, the recovery tank further including a tank inlet tube extending into the recovery tank from the tank inlet.

16. The apparatus of claim 15, wherein at least a portion of the tank inlet tube is spaced from the one or more walls to create a gap between the tank inlet tube and the one or more walls.

17. The apparatus of claim 16, wherein the portion of the tank inlet tube is spaced from the one or more walls to allow fluid to flow around the portion of the tank inlet tube spaced from the one or more walls.

18. The apparatus of claim 16, wherein the one or more walls comprise a front wall, wherein the tank inlet tube is spaced from the front wall.

19. The apparatus of claim 15, wherein the tank inlet tube extends into the recovery tank in a rearward direction.

20. The apparatus of claim 11, wherein the base includes a front portion and a rearward portion, and wherein the upper portion is operatively coupled to the rearward portion of the base.

* * * * *